US011618232B2

(12) United States Patent
Becher et al.

(10) Patent No.: US 11,618,232 B2
(45) Date of Patent: Apr. 4, 2023

(54) APPARATUS FOR CONTROLLING THE SWITCH-OVER OF HYDRAULIC CYLINDERS

(71) Applicant: MOOG GmbH, Boeblingen (DE)

(72) Inventors: Dirk Becher, Nufringen (DE); Werner Haendle, Marbach a.N. (DE); Achim Helbig, Stuttgart (DE); Christoph Boes, Reutlingen (DE)

(73) Assignee: Moog GmbH, Boeblingen (DE)

( * ) Notice: Subject to any disclaimer, the term of this patent is extended or adjusted under 35 U.S.C. 154(b) by 108 days.

(21) Appl. No.: 16/634,995

(22) PCT Filed: Aug. 1, 2018

(86) PCT No.: PCT/EP2018/070878
§ 371 (c)(1),
(2) Date: Jan. 29, 2020

(87) PCT Pub. No.: WO2019/025491
PCT Pub. Date: Feb. 7, 2019

(65) Prior Publication Data

US 2020/0180253 A1 Jun. 11, 2020

(30) Foreign Application Priority Data

Aug. 1, 2017 (DE) ..... 102017117436.2

(51) Int. Cl.
*B30B 15/16* (2006.01)
*B30B 15/18* (2006.01)
(Continued)

(52) U.S. Cl.
CPC ..... *B30B 15/161* (2013.01); *B30B 15/163* (2013.01); *B30B 15/186* (2013.01);
(Continued)

(58) Field of Classification Search
CPC ..... B30B 15/161; B30B 15/16; B30B 15/163; B30B 15/186; F15B 2211/20561;
(Continued)

(56) References Cited

U.S. PATENT DOCUMENTS 3,033,170 A 5/1962 Etal
5,852,933 A * 12/1998 Schmidt ..... F15B 21/14 60/413

(Continued)

FOREIGN PATENT DOCUMENTS

EP 2637852 * 5/2012 ..... B30B 15/161
JP H0639285 U 5/1994

(Continued)

OTHER PUBLICATIONS

European Patent Office (ISA/EP), International Search Report of the ISA in International Patent Application No. PCT/EP2018/070878, dated Feb. 7, 2019.

*Primary Examiner* — Dustin T Nguyen
(74) *Attorney, Agent, or Firm* — Harter Secrest & Emery LLP

(57) ABSTRACT

An electro-hydrostatic drive for realizing a rapid movement during a rapid movement phase, a force-building movement during a force-building movement phase. The apparatus comprises a hydro-machine with variable volume and/or rotational speed, driven by an electric motor, for providing a volume-stream of a hydraulic fluid, a first cylinder with a piston chamber, an rod chamber, and a plunger rod, a reservoir, a pressure source, a relief valve, a check valve, a fluid connection between the piston chamber and the hydro-machine, a fluid connection between the rod chamber and the hydro-machine, a fluid connection between the piston chamber and the reservoir, a fluid connection between the rod-chamber-side port of the hydro-machine and the reservoir, a fluid connection, through the relief valve, between the
(Continued)

Figure 1:
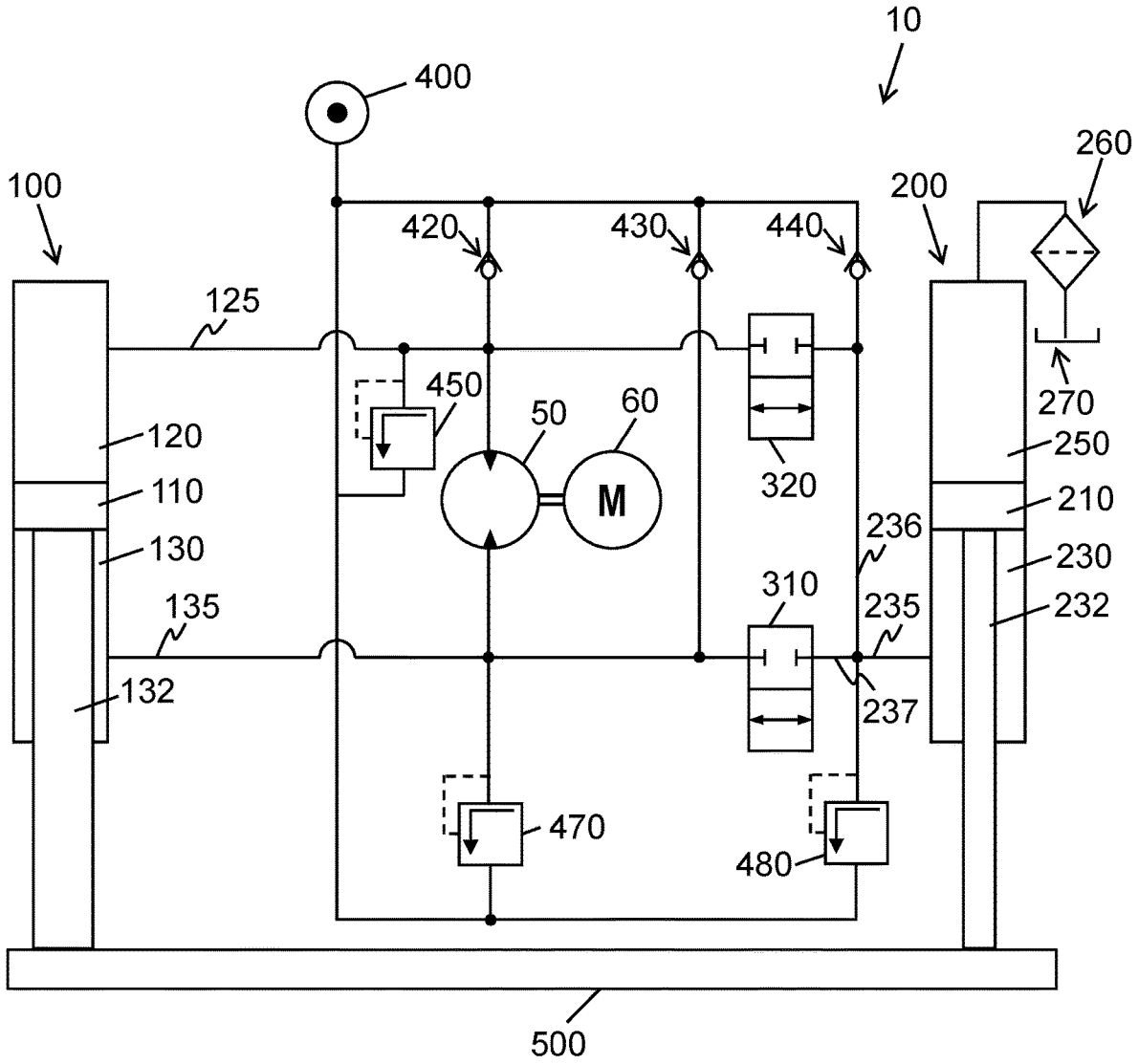

reservoir and the pressure source. The relief valve is for pressure safety of the reservoir, and the check valve has a fluid connection from the pressure source to the rod-chamber-side port of the hydro-machine, during the rapid movement phase, a first part of the hydraulic fluid is piped through the fluid connection between the piston chamber and the hydro-machine and the fluid connection between the rod chamber and the hydro-machine, and a second part of the hydraulic fluid communicates through the fluid connection between the piston chamber and the reservoir, during the force-building movement phase, a first part of the hydraulic fluid is piped through the fluid connection between the piston chamber and the hydro-machine and the fluid connection between the rod chamber and the hydro-machine, and a second part of the hydraulic fluid is piped through the fluid connection between the rod-chamber-side port of the hydro-machine and the reservoir.

10 Claims, 2 Drawing Sheets

(51) Int. Cl.
*F15B 7/00* (2006.01)
*F15B 11/02* (2006.01)

(52) U.S. Cl.
CPC ..... *F15B 7/006* (2013.01); *F15B 11/022* (2013.01); *F15B 2211/20515* (2013.01); *F15B 2211/20546* (2013.01); *F15B 2211/20561* (2013.01); *F15B 2211/27* (2013.01); *F15B 2211/6651* (2013.01); *F15B 2211/7107* (2013.01); *F15B 2211/7128* (2013.01); *F15B 2211/775* (2013.01)

(58) Field of Classification Search
CPC ..... F15B 2211/775; F15B 2211/27; F15B 7/006; F15B 11/022; F15B 2211/20515; F15B 2211/20546; F15B 2211/6651; F15B 2211/7107; F15B 2211/7128
See application file for complete search history.

(56) References Cited

U.S. PATENT DOCUMENTS

| | | | | |
|---|---|---|---|---|
| 5,913,810 | A | 6/1999 | Andre | |
| 9,623,463 | B2 * | 4/2017 | Yukita | B30B 15/22 |
| 9,688,041 | B2 * | 6/2017 | Scheidl | B30B 15/16 |
| 9,771,957 | B2 * | 9/2017 | Maier | F15B 11/0365 |
| 9,790,964 | B2 | 10/2017 | Johnson | |
| 9,903,394 | B2 * | 2/2018 | Brahmer | F15B 13/024 |
| 10,302,101 | B2 * | 5/2019 | Schaber | F15B 13/0401 |
| 10,626,889 | B2 * | 4/2020 | Händle et al. | B30B 15/161 |
| 11,384,778 | B2 * | 7/2022 | Dany | F15B 11/22 |
| 2012/0272708 | A1 | 11/2012 | Scheidl et al. | |
| 2016/0084276 | A1 | 3/2016 | Schaber | |
| 2016/0084278 | A1 | 3/2016 | Junginger | |
| 2016/0084280 | A1 | 3/2016 | Maier | |
| 2017/0108014 | A1 | 4/2017 | Haendle et al. | |
| 2019/0162208 | A1 * | 5/2019 | Haendle | F15B 15/18 |

FOREIGN PATENT DOCUMENTS

| | | | |
|---|---|---|---|
| JP | H0639285 | U | 5/1994 |
| WO | WO-2011-035828 | A1 | 3/2011 |
| WO | WO-2012-062416 | A1 | 5/2012 |

* cited by examiner

APPARATUS FOR CONTROLLING THE SWITCH-OVER OF HYDRAULIC CYLINDERS

The present invention relates to hydraulic presses, particularly to hydraulic presses that have both a force-building movement and a rapid movement.

Hydraulic presses are known in the art. Usually, they have an additional reservoir, which is not directly involved in the press's "productive movements", e.g., in the force-building movement and the rapid movement, but supports the hydraulic pump, in order to maintain a high system pressure also in phases, e.g., in transition phases, when the pump does not deliver pressure to all passageways that need hydraulic pressure in the current phase or the next phase of the hydraulic press. The components and the passageways of the hydraulic system that are directly involved in the "productive movements" are called the "productive part" of the hydraulic system.

Such an apparatus has, among others, at least following disadvantages: During a transition phase, the pressure can only be as high as available from the additional reservoir. Hence, much energy, e.g. from the pump, is required in the next phase to re-establish the pressure that is necessary for the press' movements.

Therefore, it is a task of the present invention to overcome the disadvantages of the state of the art, at least partly. This task is solved by the system according to claim 1. Preferred embodiments are the subject of dependent claims.

An apparatus according to the present invention is an electro-hydrostatic drive for realizing a rapid movement during a rapid movement phase and a force-building movement during a force-building movement phase. In some embodiments, also a transition phase between the rapid movement phase and the force-building movement phase is supported. The apparatus comprises a hydro-machine with variable volume and/or rotational speed, driven by an electric motor, for providing a volume-stream of a hydraulic fluid, a first cylinder with a piston chamber, an rod chamber, a plunger rod, a reservoir, a pressure source, a relief valve, and a check valve.

Furthermore, the apparatus has several fluid connections: a fluid connection between the piston chamber and the hydro-machine, a fluid connection between the rod chamber and the hydro-machine, a fluid connection between the piston chamber and the reservoir, a fluid connection between the rod-chamber-side port of the hydro-machine and the reservoir, and a fluid connection, through the relief valve, between the reservoir and the pressure source.

The invention is characterized in that the relief valve is for pressure safety of the reservoir, and the check valve has a fluid connection from the pressure source to the rod-chamber-side port of the hydro-machine. Furthermore, the invention is characterized by the system's configuration in its phases. During the rapid movement phase, a first part of the hydraulic fluid is piped through the fluid connection between the piston chamber and the hydro-machine and the fluid connection between the rod chamber and the hydro-machine, and a second part of the hydraulic fluid communicates through the fluid connection between the piston chamber and the reservoir. During the force-building movement phase, a first part of the hydraulic fluid is piped through the fluid connection between the piston chamber and the hydro-machine and the fluid connection between the rod chamber and the hydro-machine, and a second part of the hydraulic fluid is piped through the fluid connection between the rod-chamber-side port of the hydro-machine and the reservoir. In some embodiments, during the transition phase between the rapid movement phase and the force-building movement phase, a first part of the hydraulic fluid is piped through the fluid connection between the piston chamber and the hydro-machine and the fluid connection between the rod chamber and the hydro-machine, and a second part of the hydraulic fluid communicates through the fluid connection, through one of the relief valves and one of the check valves, between the piston chamber and the reservoir.

This system has the advantage that in all phases—also during the transition phase—a high pressure is maintained within the hydraulic system, at least in its "productive part". The system pressure is determined by the respective relief valve and comes from the reservoir that is involved in the productive phases, i.e. force-building movement and a rapid movement. By this arrangement of a system according to the present invention, the system pressure is significantly higher than the pressure, which can be delivered by an additional reservoir.

In addition, the system provides additional force for force-building movements, because the reservoir only loses small amounts of the system pressure in the transition phase. Moreover, this reduces the switchover-time between the "productive movements" of the press.

An electro-hydrostatic drive according to the present invention performs a rapid movement upwards by setting this arrangement: During the rapid movement upwards, a first part of the hydraulic fluid is piped through the fluid connection from the piston chamber to the hydro-machine and the fluid connection from the hydro-machine to the rod chamber, and a second part of the hydraulic fluid communicates through the fluid connection from the piston chamber to the reservoir.

During a rapid movement downwards, the same fluid connections are opened as for the rapid movement upwards, but the hydro-machine is run in reverse direction, and thus the hydraulic fluid flows in opposite directions in these fluid connections.

The drive according to the present invention performs a force-building movement upwards by setting this arrangement: During a force-building movement upwards, a first part of the hydraulic fluid is piped through the fluid connection from the piston chamber to the hydro-machine and the fluid connection from the hydro-machine to the rod chamber, and a second part of the hydraulic fluid is piped through the fluid connection from the rod-chamber-side port of the hydro-machine to the reservoir.

During a force-building movement downwards, the same fluid connections are opened as for the force-building movement upwards, but the hydro-machine is run in reverse direction, and thus the hydraulic fluid flows in opposite directions in these fluid connections.

In some embodiments, during a transition phase between the rapid movement upwards and the force-building movement upwards, a first part of the hydraulic fluid is piped through the fluid connection from the piston chamber to the piston-chamber-side of the hydro-machine, and the fluid connection from the rod-chamber-side of the hydro-machine to the rod chamber, and a second part of the hydraulic fluid communicates through the fluid connection, through a first relief valve and a first check valve, from the piston chamber to the reservoir.

In some embodiments, the relief valve has an outlet pressure between 5 bar and 50 bar, preferably between 15 bar and 30 bar. This pressure is chosen, because a significantly lower outlet pressure would shortcut the system pressure and consequently lead to higher loss of the system's energy. On the other side, with a significantly higher outlet pressure, the system would be stuck in transition phases, at least for embodiments where the reservoir is realized as a hydraulic cylinder.

In some embodiments, the relief valve is proportionally adjustable. This has the advantage that the outlet pressure can be changed and optimized during an operation of the hydraulic system.

Furthermore, electronic control of the outlet pressure, and thus further optimization becomes possible.

In some embodiments, the reservoir is an accumulator. In these embodiments, a system can be implemented with, in comparison, low cost. This makes use of some architectural features of this system, which enable the first cylinder to perform both the rapid movement and the force-building movement.

In some preferred embodiments, the reservoir is implemented as a second cylinder, which has a piston, a piston chamber, an rod chamber, and a plunger rod.

These embodiments may be implemented in a way that the cylinder area of the rod chamber of the second cylinder plus the cylinder area of the rod chamber of the first cylinder equals the cylinder area of the piston chamber of the first cylinder. Consequently, the combination of the first and the second cylinder becomes a balanced cylinder situation. Using a balanced cylinder situation allows on the one hand using a standard single hydro-machine on the other hand it allows to reduce the volume of the pressure source.

In some embodiments, the plunger rod of the first cylinder and the plunger rod of the second cylinder are mechanically connected via a mass. Connection of the cylinder leads to a parallel movement of the cylinders. Via the mechanical connection it is possible to build up the full force during force-building movement either in extending or retracting direction. Such functionality is needed to generate e.g. ejector or strip forces.

In some embodiments, the drive has a first 2-port/2-way control valve and a second 2-port/2-way control valve, each of them having states "opened" and "closed", where the first valve can open—in state "opened"—the fluid connection between the rod-chamber-side port of the hydro-machine and the reservoir, and the second valve can open the fluid connection between the piston chamber and the reservoir. During the rapid movement phase, the system is run with the first valve in state "closed" and the second valve is in state "opened". During the force-building movement phase, the first valve is in state "opened" and the second valve is in state "closed". In some embodiments, during the transition phase, the first valve is in state "closed" and the second valve is in state "closed".

In some embodiments, the check valve has a fluid connection to the pressure source. This brings the advantage of avoiding cavitation in the hydro-machine.

In some embodiments, an additional check valve has a fluid connection to the pressure source. This contributes to avoid cavitation in the reservoir.

In some embodiments, additional relief valves are for pressure safety of both connections of the hydro-machine.

Further objects of the invention will be brought out in the following part of the specification.

Figure 2:
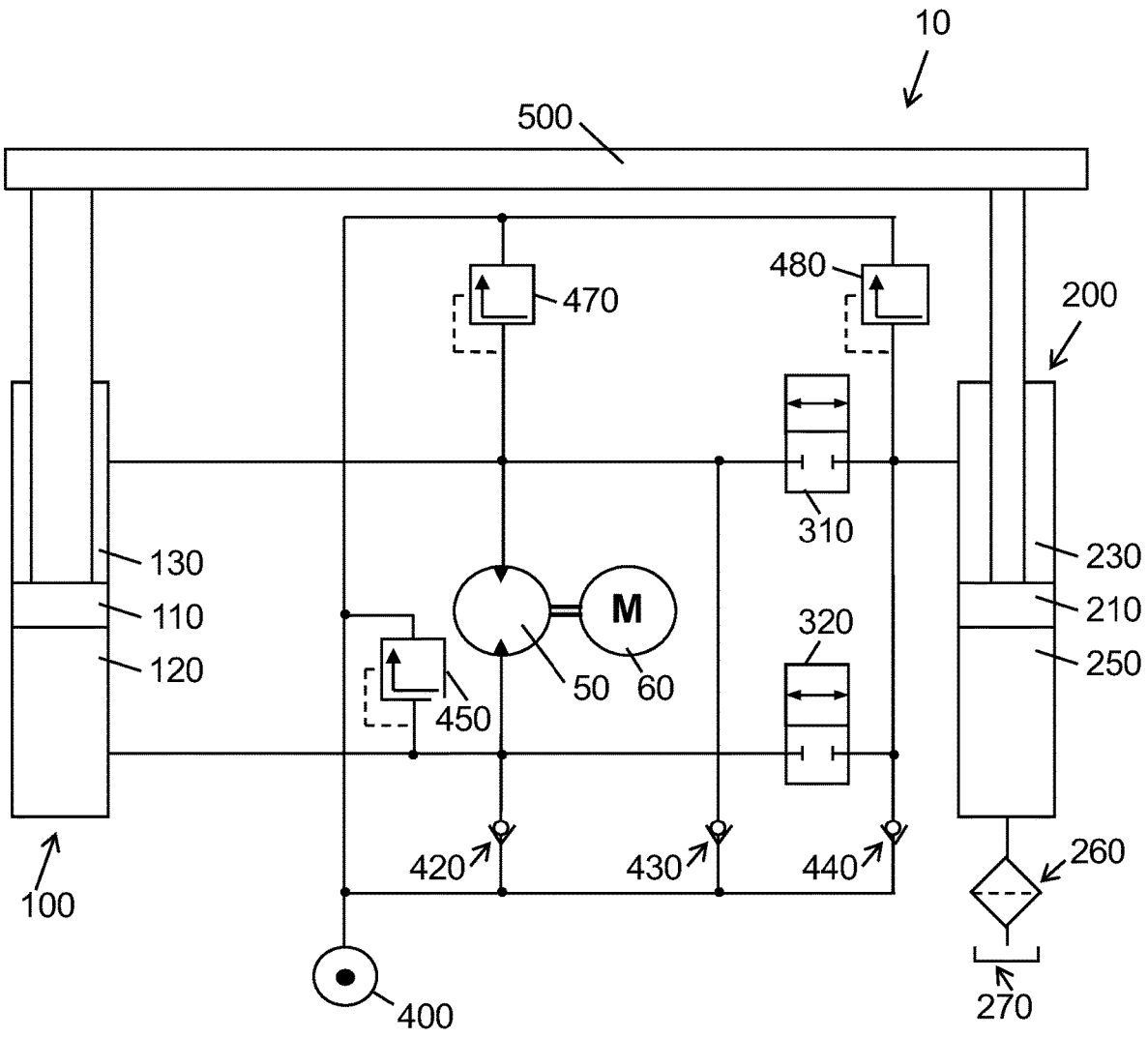

The figures show:

FIG. 1: Schematic drawing of a first embodiment of an electro-hydrostatic drive according to the present invention;

FIG. 2: Schematic drawing of a second embodiment of an electro-hydrostatic drive according to the present invention.

FIG. 1 depicts a schematic drawing of a first embodiment of the present invention. On the left side of the drawing, first cylinder 100 is shown, with its components piston 110, piston chamber 120, rod chamber 130, and plunger rod 132. On the right side, second cylinder 200 is shown, with piston 210, rod chamber 230, plunger rod 232, and piston chamber 250. From piston chamber 250, a passage leads to an open tank 270, via filter 260. The plunger rods 132 and 232 of the first and the second cylinder, 100 and 200, are mechanically connected via mass 500. In the centre of the drawing, pump 50 is shown, which is driven by the electric motor 60, with variable volume and/or rotational speed.

The passage 125 connects piston chamber 120 of the first cylinder 100 with the piston-chamber-side port of the hydro-machine 50. The rod-chamber-side port of the hydro-machine is connected, via fluid connection or passage 135, with rod chamber 130 of the first cylinder 100 and, via passage 237 and 235, with rod chamber 230 of the second cylinder 200. Passage 237 can be opened and closed with first 2-port/2-way control valve 310. A further fluid connection is established between piston chamber 120 of the first cylinder 100 and rod chamber 230 of the second cylinder 200, via passage 236 and 235. Passage 236 can be opened and closed with first 2-port/2-way control valve 320. Furthermore, pressure source 400 is shown. From pressure source 400, fluid can communicate to passage 125 or 236, via check valve 420 or 440, respectively. Said pressure source 400 is filled from the "productive part" either from passage 235, via relief valve 480, or from passage 125, via relief valve 450. When control valve 310 and 320 are closed and the hydraulic system is in transition phase between the rapid movement upwards and the force-building movement downwards, pressure fluid from rod chamber 230 of the second cylinder 200 may flow, via passage 235 and relief valve 480, to pressure source 400 and from pressure source 400, via check valve 420 and passage 125, to piston chamber 120.

For a rapid movement upwards, the hydro-machine 50 moves the hydraulic fluid from its piston-chamber-side port to its rod-chamber-side port, i.e. "downwards" in this drawing. Besides, first control valve 310 is in state "closed" and second control valve 320 is in state "opened". Thus, a first part of the hydraulic fluid is piped from piston chamber 120 to the hydro-machine 50, through fluid connection 125, and from the hydro-machine 50 to the rod chamber 130 of the first cylinder 100. Hence, plunger rod 132 is driven upwards. This takes mass 500 upwards, too. Since mass 500 is connected to the plunger rod 232 of the second cylinder 200, plunger rod 232 is also moved upwards. Thus, a second part of the hydraulic fluid from piston chamber 120 flows, via second control valve 320 and passage 236 and 235, to the rod chamber 230 of the second cylinder 200.

In an embodiment, second cylinder 200 may be a reservoir. This reservoir will be filled in the rapid movement upwards because there is a fluid connection, via second control valve 320 and passage 236 and 235, with the fluid of the differential cylinder 100.

For a force-building movement upwards, the hydro-machine 50 moves the hydraulic fluid from its piston-chamber-side port to its rod-chamber-side port, i.e. "downwards" in this drawing. The first control valve 310 is in state "opened" and second control valve 320 is in state "closed". Consequently, a first part of the hydraulic fluid is piped through the fluid connection 125 from the piston chamber 120 of the first cylinder 100 to the hydro-machine 50 and the fluid connection 135 from the hydro-machine 50 to the rod chamber 130, and a second part of the hydraulic fluid is piped through the fluid connection 237, 235 from the rod-chamber-side port of the hydro-machine 50 to the rod chamber 230 of the second cylinder 200, via control valve 310 and passage 237 and 235.

By this, the piston area of both rod chamber 130 of the first cylinder 100 and rod chamber 230 of the second cylinder 200 forces mass 500 to go up.

When switching between the rapid movement upwards and the force-building movement upwards, a transition phase occurs, in which the cylinders are not intended to move, but the fluid connections need to be switched-over. In this transition phase, both the first control valve 310 and the second control valve 320 are in state "closed". In this phase, there is still higher pressure in piston chamber 120 of the first cylinder 100, possibly caused by inertia of the moving components. In the system of FIG. 1, relief valve 450 is opened, due to this higher pressure. This avoids damages in the hydraulic system, but also prevents the plunger rod 132 of the first cylinder 100 to be stopped immediately. The hydraulic fluid, which is—in this transition phase—not needed for a movement, is then moved, via first relief valve 450, to pressure source 400 and/or, via first check valve 440, to passage 235.

The movements downwards use the same fluid connections and valves as pointed out above, but the hydraulic fluid flows into the opposite direction.

The relief valves 480 and 450 have an outlet pressure between 5 bar and 50 bar, preferably between 15 bar and 30 bar. This proved to be beneficial for the presses used in systems used for hydraulic presses. In some embodiments, it turned out to be useful if the relief valves 480 and 450 can change their outlet pressure. This can be achieved by using a proportional valve, which can be controlled by electronic devices.

FIG. 2 depicts a schematic drawing of a second embodiment of an electro-hydrostatic drive according to the present invention, where mass 500 is arranged above the driving cylinders. The same numbers of the reference signs as in FIG. 1 refer to the same components of the system.

The movements are implemented similarly to the movements pointed out for the embodiment of FIG. 1. For a clear understanding, one of the movements, namely the force-building movement upwards, is explained.

In this embodiment, for a force-building movement upwards, the hydro-machine 50 moves the hydraulic fluid from its rod-chamber-side port to its piston-chamber-side port, i.e. "downwards" in this drawing. The first control valve 310 is in state "opened" and second control valve 320 is in state "closed". Hence, a first part of the hydraulic fluid is piped from the rod chamber 130 of the first cylinder 100 and a second part of the hydraulic fluid is piped from rod chamber 230 of the second cylinder 200 to the hydro-machine 50. Thus, the hydraulic fluid is piped from hydro-machine 50 to the piston chamber 120 of the first cylinder 100.

The mechanism of the invention, as shown for instance in the embodiments of FIG. 1 and FIG. 2, enables a fast switch-over between rapid movement and force-building movement for hydraulic systems, particularly presses, implemented by a relatively small number of components.

LIST OF REFERENCE SIGNS

10 hydraulic drive
50 pump
60 electric motor
100 first cylinder
110 piston, first cylinder
120 piston chamber, first cylinder
125, 135 passageways
130 rod chamber, first cylinder
132 plunger rod, first cylinder
200 second cylinder/reservoir
210 piston, second cylinder
230 rod chamber, second cylinder
232 plunger rod, second cylinder
250 piston chamber, second cylinder
235, 236, 237 passageways
260 filter
270 open tank
310, 320 2-port/2-way control valve
400 pressure source
420, 430, 440 check valve
450, 470, 480 relief valve
500 mass

The invention claimed is:

1. An electro-hydrostatic drive for realizing a rapid movement during a rapid movement phase, a force-building movement during a force-building movement phase and a transition phase between the rapid movement phase and the force-building movement phase, comprising:

a hydro-machine having a variable volume and/or a variable speed, wherein the hydro-machine is driven by an electric motor, and wherein the hydro-machine is arranged to provide a flow of a hydraulic fluid;

a first cylinder having a piston chamber, a rod chamber, and a rod;

a second cylinder having a piston chamber, a rod chamber, and a rod, wherein the rod chamber is arranged as a reservoir;

a pressure source in selective fluid connection with the first cylinder and the second cylinder;

a relief valve;

a check valve;

a fluid connection between the piston chamber of the first cylinder and a piston-chamber-side port of the hydro-machine;

a fluid connection between the rod chamber of the first cylinder and a rod-chamber-side port of the hydro-machine;

a fluid connection between the piston chamber of the first cylinder and the reservoir;

a fluid connection between the rod-chamber-side port of the hydro-machine and the reservoir;

a fluid connection, through the relief valve, between the reservoir and the pressure source;

wherein the relief valve is operable to provide pressure safety to the reservoir, and the check valve has a fluid connection from the pressure source to the rod-chamber-side port of the hydro-machine;

during the rapid movement phase, a first part of the hydraulic fluid is communicated via the fluid connection between the piston chamber of the first cylinder and the piston-chamber-side port of the hydro-machine and the fluid connection between the rod chamber of the first cylinder and the rod-chamber-side port of the hydro-machine, and a second part of the hydraulic fluid is communicated through the fluid connection between the piston chamber of the first cylinder and the reservoir;

during the force-building movement phase, a first part of the hydraulic fluid is communicated via the fluid connection between the piston chamber of the first cylinder and the piston-chamber-side port of the hydro-machine and the fluid connection between the rod chamber of the first cylinder and the rod-chamber-side port of the hydro-machine, and a second part of the hydraulic fluid is communicated through the fluid connection between the rod-chamber-side port of the hydro-machine and the reservoir; and the rod of the first cylinder and the rod of the second cylinder are mechanically connected via a mass, and during the transition phase wherein the first and second cylinders are substantially stationary, the fluid connection between the piston chamber of the first cylinder and the reservoir is closed, and the fluid connection between the rod-chamber-side port of the hydro-machine and the reservoir is closed, wherein the hydraulic fluid does not flow between the reservoir and the rod-chamber-side port of the hydro-machine when the fluid connection therebetween is closed during the transition phase.

2. The electro-hydrostatic drive according to claim 1, wherein during a rapid movement upwards, a first part of the hydraulic fluid is communicated through the fluid connection from the piston chamber to the piston-chamber-side port of the hydro-machine and the fluid connection from the rod-chamber-side port of the hydro-machine to the rod chamber, and a second part of the hydraulic fluid is communicated through the fluid connection from the piston chamber to the reservoir.

3. The electro-hydrostatic drive according to claim 1, wherein during a force-building movement upwards, a first part of the hydraulic fluid is communicated through the fluid connection from the piston chamber to the piston-chamber-side port of the hydro-machine and the fluid connection from the rod-chamber-side port of the hydro-machine to the rod chamber, and a second part of the hydraulic fluid is communicated through the fluid connection from the rod-chamber-side port of the hydro-machine to the reservoir.

4. The electro-hydrostatic drive according to claim 1, wherein the relief valve has an outlet pressure between 5 bar and 50 bar.

5. The electro-hydrostatic drive according to claim 1, wherein the relief valve is proportionally adjustable.

6. The electro-hydrostatic drive according to claim 1, wherein the reservoir is an accumulator.

7. The electro-hydrostatic drive according to claim 1, wherein the drive has a first 2-port/2-way control valve and a second 2-port/2-way control valve, each of them having states "opened" and "closed", where the first valve can open the fluid connection between the rod-chamber-side port of the hydro-machine and the reservoir, and the second valve can open the fluid connection between the piston chamber and the reservoir, and wherein during the rapid movement phase, the first valve is in state "closed" and the second valve is in state "opened", and wherein during the force-building movement phase, the first valve is in state "opened" and the second valve is in state "closed".

8. The electro-hydrostatic drive according to claim 1, wherein the check valve has a fluid connection to the pressure source to avoid cavitation in the hydro-machine.

9. The electro-hydrostatic drive according to claim 1, wherein an additional check valve has a fluid connection to the pressure source to avoid cavitation in the reservoir.

10. The electro-hydrostatic drive according to claim 1, wherein a second relief valve in fluid communication with the piston chamber of the first cylinder and the piston-chamber-side port of the hydro-machine, and a third relief valve in fluid communication with the rod-chamber-side port of the hydro-machine and the reservoir are operable to provide pressure safety to both connections of the hydro-machine.

* * * * *